United States Patent [19]

Jung

[11] 3,956,057

[45] May 11, 1976

[54] APPARATUS AND PROCESS FOR BINDING BOOKS WITH MOLTEN ADHESIVE

[76] Inventor: Dietrich Jung, In der Aue 1, 5202 St. Augustin, Germany

[22] Filed: Jan. 28, 1974

[21] Appl. No.: 437,582

[30] Foreign Application Priority Data

June 6, 1973 Germany ..... 2328723

[52] U.S. Cl. ..... 156/578; 11/1 AD; 118/242; 281/21 R; 156/477 B

[51] Int. Cl.[2] ..... B65C 11/04

[58] Field of Search ..... 11/1 AD, 5, 1 B; 118/64, 242, 69, 244, 236, 503, 241; 156/578, 499, 477 B, 582, 497, 305, 498, 311, 228, 583, 356, 357; 117/111 R; 281/21 R; 269/47, 54.2, 49, 54.3; 93/56 PD, 36 MM; 165/89; 74/37

[56] References Cited

UNITED STATES PATENTS

| | | | |
|---|---|---|---|
| 170,927 | 12/1875 | Withington | 74/37 |
| 1,871,492 | 8/1932 | Brennecke | 156/228 |
| 3,146,127 | 8/1964 | Geoffroy et al. | 118/242 |
| 3,223,436 | 12/1965 | Becker | 281/21 R |
| 3,532,363 | 10/1970 | Abildgaard et al. | 281/29 |
| 3,750,746 | 8/1973 | Norman | 156/578 |
| 3,757,736 | 9/1973 | Anderson | 11/1 AD |
| 3,866,568 | 2/1975 | Minami | 118/241 |

*Primary Examiner*—William A. Powell
*Assistant Examiner*—J. J. Gallagher
*Attorney, Agent, or Firm*—Burgess, Dinklage & Sprung

[57] ABSTRACT

An apparatus for gluing a stack of aligned sheets into a pad or book with a molten adhesive, comprising means for clamping said sheets with the aligned edges to be glued facing downwardly, a crucible for adhesive, means for melting said adhesive in said crucible, a glue applicator roll dipping into the molten adhesive in said crucible and extending above said adhesive, and means for effecting relative movement between said clamping means and said crucible with said applicator roll, whereby said applicator roll applies adhesive to the aligned edges of said sheets. The crucible and applicator roll, preferably with an upstream air blower, are desirably positioned between a pair of parallel endless chains which are moved below the stationary sheets.

7 Claims, 4 Drawing Figures

APPARATUS AND PROCESS FOR BINDING BOOKS WITH MOLTEN ADHESIVE

The present invention relates to an apparatus and a method for gluing book and paper pads by the melt adhesive process. This process avoids the stitching of the book pad to be bound. The lower edges of the sheets are instead adhesively bonded together thereby providing a rapid, simple and durable binding. Due to the great number of records and paper files which are accumulated in modern offices in various forms and must be tied together in clearly arranged form before being passed on or forwarded or stored, there is especially a need for small and convenient adhesive bindung machines which can be readily operated also by unskilled operators.

Commercial bookbinding machines operating by the melt adhesive process are known. However, these machines have disadvantages due to which they are used only to a restricted extent. In particular, they are too large and bulky and, therefore, require an excessively large floor space for installation and operation. Moreover, due to the high investment and maintenance cost, the use of these machines is advantageous only for bookbinderies. Cooling and setting of the melt adhesive applied to the back of the book takes as much as 30 seconds with these machines.

It is, therefore, an object of the present invention to provide an adhesive binding machine having small dimensions and an adhesive binding method which requires substantially shorter cooling periods.

In accordance with the present invention there is provided an apparatus for gluing a stack of aligned sheets into a pad or book with a molten adhesive, comprising means for clamping said sheets with the aligned edges to be glued facing downwardly, a crucible for adhesive, means for melting said adhesive in said crucible, a glue applicator roll dipping into the molten adhesive in said crucible and extending above said adhesive, and means for effecting relative movement between said clamping means and said crucible with said applicator roll, whereby said applicator roll applies adhesive to the aligned edges of said sheets.

Advantageously the means for effecting relative movement comprises a pair of spaced parallel endless chains, said crucible with applicator roll being positioned between said chains and resiliently connected to both chains, and a drive for moving said chains and the crucible and applicator roll therewith below and longitudinally of the stationary stack of sheets so as to apply adhesive thereto.

In a preferred embodiment there are provided a plurality of cross-bars connecting said chains, the cross-bars downstream of said crucible, for a distance equal to at least about the length of the sheets to be glued, being substantially circular in cross-section so as to contact the aligned edges, the cross-bars upstream of said crucible for at least about an equal distance being substantially flat in cross-section so as not to contact the edges after adhesive has been applied thereto.

A particularly advantageous embodiment of the adhesive binding machine according to the invention is provided with a cooling blower having an elongated outlet nozzle which is mounted at the back side of the adhesive applicator parallel to the cross bars in a manner such that it cools the hot melt adhesive having been applied to the back of the book.

The invention also relates to a process for gluing book and paper pads according to the melt adhesive method wherein the book pad is clamped with its back showing downwardly and is coated with a melt adhesive by means of a glue applicator roll, the method being characterized in that the glue applicator roll passes beneath the stationary book pad as it applies the melt adhesive.

According to a preferred embodiment of the method, the melt adhesive having been applied to the back of the book is cooled by means of a blower immediately after having been applied.

The instant invention will be described with reference to the accompanying drawings which show an embodiment of the adhesive binding machine according to the invention and of which FIG. 1 is a vertical longitudinal section of the machine of the instant invention;

Figure 1:
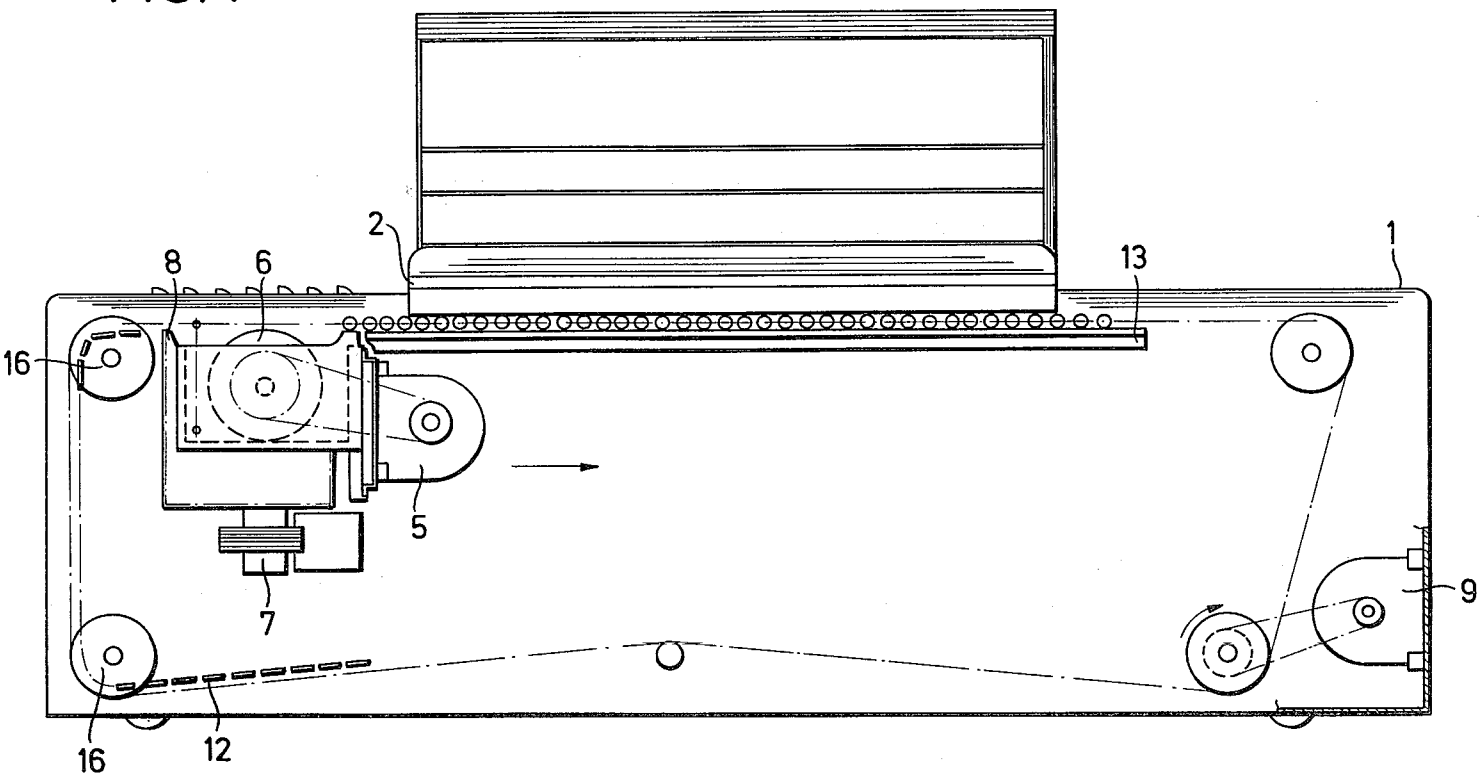

The embodiments shown in the drawings comprise a housing 1 which is preferably made of metal sheet and on the top of which a clamping device is mounted. The adhesive applicator assembly 3 substantially consists of a heatable melting crucible 4 containing the melt adhesive, a glue applicator roll 6 which is also heatable and applies the melt adhesive to the book pad clamped in the clamping device 2, and a drive 5 for the glue applicator roll. Preferably the heating elements for the glue applicator roll and the melting crucible are tightly embedded by casting in the roll and the crucible, respectively. This makes the roll and crucible insensitive to troubles and failure, and the time necessary for heating up is very short. In case of the embodiment shown in the drawing, the adhesive applicator assembly 3 is connected with the cooling blower 7, the output nozzle 8 of which is of elongated shape and directs the air current upwardly.

The adhesive applicator assembly 3 is resiliently suspended at the two drawing chains 10. These drawing chains are driven by the transportation drive 9 and partially run on the slide rails 13 and are partially guided by guide rolls 16. The individual links of the parallel drawing chains adjoining the adhesive applicator assembly downstream are interconnected by roll-shaped cross bars 11 for at least a length corresponding to the clamping device. At the upstream side of the adhesive applicator assembly, the links of the drawing chains adjoining the assembly are connected by means of plate-shaped cross bars 12. The roll-shaped cross bars 11 serve the purpose of obtaining an exact adjustment of the lower edge of the paper to the upper edge of the glue applicator roll 6. The plate-shaped cross bars 12 are lower in height than the roll-shaped cross bars 11 so that they are incapable of contacting the glue coating applied to the book pad as long as the latter is clamped. However, they serve to prevent the book pad from falling into the machine as the clamping device is opened.

Both the heating and the temperature of the melting crucible 4 and the glue applicator roll 6 as well as the drive 5 and the transportation drive 9 are automatically controlled by means of standard controls which are known. In carrying out the process of the invention, the book pad 15 is first fixed between the clamping jaws 14 of the clamping device 2 in such a manner that its lower edge is supported by the roll-shaped cross bars 11. Then the drive 5 drives glue applicator roll 6 which rotates in the preheated melting pot 4 and picks up liquid melt adhesive. When drive 9 is switched on, it moves chain 10 from left to right, or right to left. At a suitable point, the adhesive applicator assembly 3 may be diverted by a baffle plate such that the glue applicator roll 6 and the melt adhesive adhering thereto do not contact the vertical rear edge of the book pad 15 but the melt adhesive is applied only to the underside of the book pad. The resilient suspension of the melting crucible 4 and the glue applicator roll 6 ensures that the glue applicator roll remains constantly in contact with the book pad as it passes underneath the latter and applies a uniform melt adhesive coating to the back of the book.

When the drawing chains are set in motion, the cooling blower 7 is also started and blows cool air onto the back of the book having been freshly coated with thermoplastic adhesive thereby cooling the molten adhesive. After the adhesive applicator assembly 3 has completed its travel below the back of the book, a limit switch stops the transportation drive 9 so that the adhesive applicator assembly is brought into its inoperative position. After a short delay of not more than 6 to 8 seconds, the molten adhesive on the book pad has become cooled and sufficiently set that the book pad 15 can be removed from the clamping device 2. When the clamping device is opened it touches a limit switch which actuates drive 9 and returns the applicator assembly to its original starting position.

Figure 2:
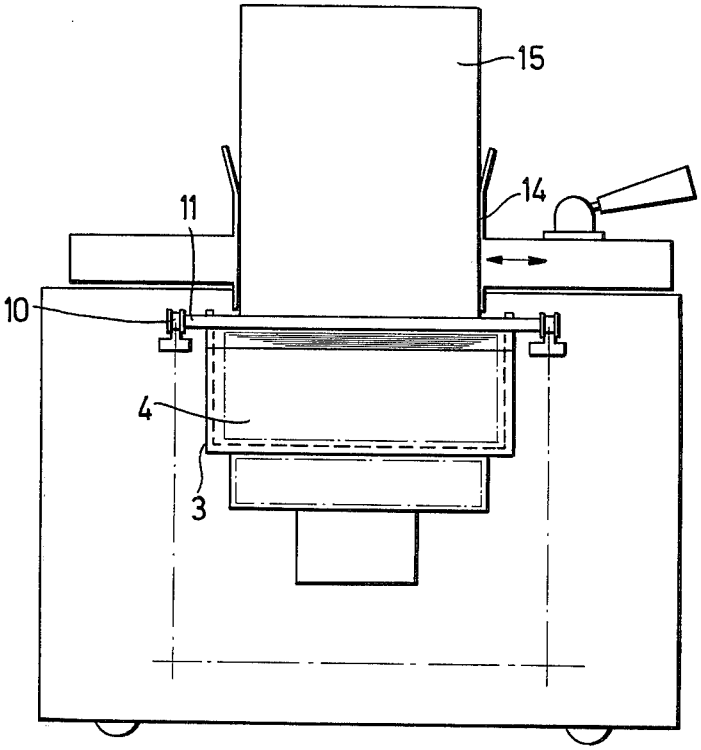
FIG. 2 is a view of a narrow side of the machine.
Figure 3:
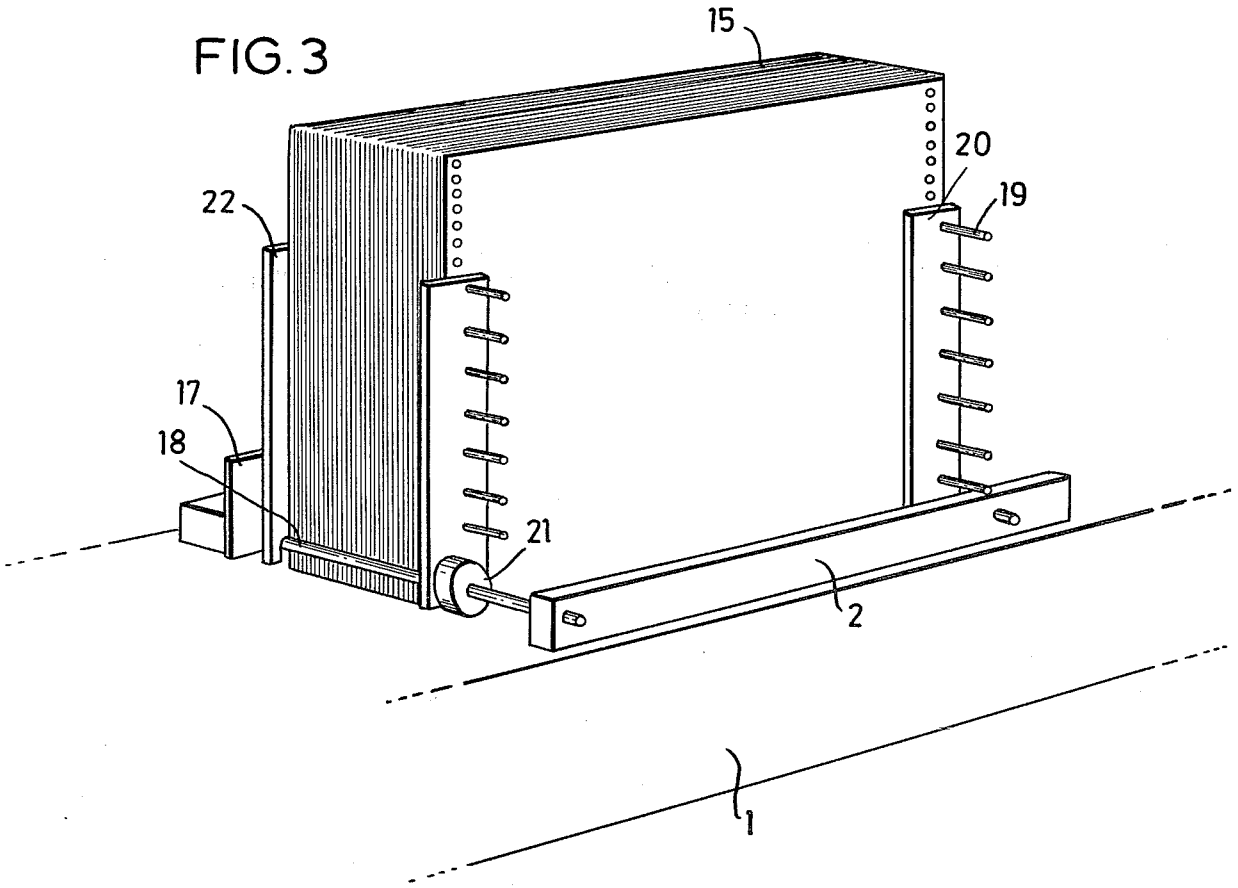
FIG. 3 shows a preferred embodiment of the clamping device.
Figure 4:
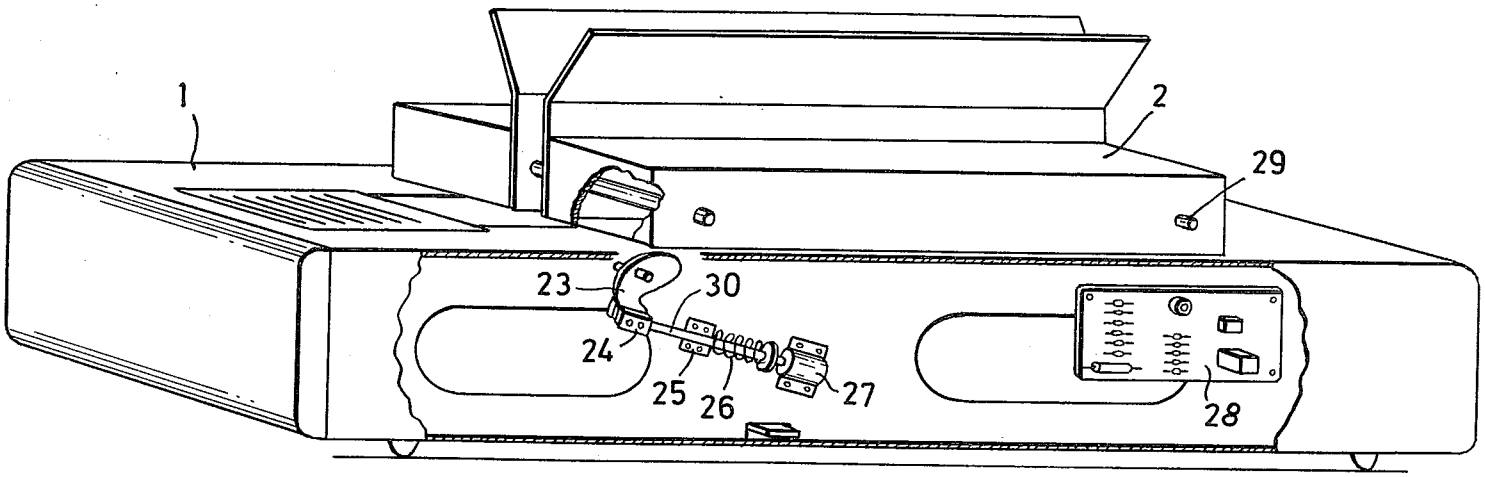
FIG. 4 is an oblique side elevation of a further embodiment of the invention with parts of the machine omitted.

The clamping device for the book pad may be a conventional clamping device as is indicated by way of example in FIGS. 1, 2 and 4. The clamping device shown in FIG. 3 is particularly suitable for binding punched paper as obtained, for example, as print in electronic data processing units and computers. This clamping device consists of a backing ledge 17 in which shafts 18 are secured. The backing ledge 17 and the shafts 18 are stationarily mounted on the machine. The backing ledge 17 supports a registering wicket 22 consisting of a plate having secured thereto pins 19 having the same distance as the holes of the paper to be clamped. The pins 19 are supported on the other side of the book pad by the socket bar 20 which can be secured by means of the slide lock 21 which is slidably mounted on the shaft 18 thereby fixing the book pad. It is possible by means of the clamping device shown in FIG. 3 to adjust and register punched sheets better and more rapidly than with known clamping devices. Moreover, the registering wicket 22 with the book pad 15 and the socket bar 20 can be removed from the clamping device so that it is possible when using a plurality of registering wickets for an adhesive binding machine to register a further book pad on a further registering wicket 22 separately from the adhesive binding machine during the time when adhesive is applied in accordance with the invention to a book pad 15 clamped in the machine. This permits enhancing of the capacity of the adhesive binding machine while simultaneously improving the quality of the adhesive bonds by improved adjustment and registering.

In a further preferred embodiment of the invention, the surface of the glue applicator roll 6 is roughened to some extent. Roughening can be effected, for example, by sand blasting to a depth of the roughness of about 5 microns. Glue applicator rolls which are roughened in this mannner ensure in any case satisfactory and uniform application of the glue to the back of the book.

Commercially available thermoplastic adhesives undergo slow degradation when they are kept at the processing temperature of about 150°C for an extended period of time. Therefore, it is undesirable to leave the heater of the adhesive applicator assembly energized if the adhesive binding machine is needed only at spaced intervals of time. However, to ensure constant readiness for immediate operation of the machine, a separate and special circuit may be provided by means of which the adhesive applicator assembly is maintained at a temperature below the operating temperature but above the setting point of the thermoplastic adhesive. A temperature of about 30°C. below the operating temperature has been found to be particularly advantageous. However, this waiting temperature is, of course, dependent on the properties of the adhesive binder used.

As has been indicated above, the adhesive applicator assembly may be guided by a baffle plate in such a manner that the glue applicator roll 6 does not strike the vertical rear edge of the book pad 15. Instead of using a baffle plate, this can be also achieved by means of the lifting assembly for the clamping device 2 as shown in FIG. 4. This lifting assembly substantially consists of a cam 23, a lever 30 terminating in a forkhead 24, a supporting bracket 25, a compression spring 26 and a solenoid 27. When the circuit is closed or broken, the solenoid 27 effects through the lever 30 and the cam 23 an upward or downward movement of the clamping device 2 about the shaft 29.

The binding process with this lifting assembly proceeds as follows: As soon as the machine is ready for operation, and a book pad has been clamped and fixed, the circuit in which the electromagnet 27 is connected is closed by pushing the starting button thereby lifting the clamping device 2. Simultaneously with the contact start, advance of the adhesive applicator assembly in the binding direction begins. Between the inoperative position of the adhesive applicator assembly, i.e. the initial position, and the back of the book there is a distance of about 60 mm. At the end of the travel of about 60 mm. before the glue applicator roll 6 approaches the back of the book, there is mounted a microswitch which, by contact with the adhesive applicator assembly, breaks the circuit in which the electromagnet is connected thereby effecting lowering of the back of the book with the clamping device to the glue applicator roll. Thereby the clamping device is lowered to its initial level and the glue applicator roll contacts the back of the book exactly at its beginning. It is ensured in this manner that the roll 6 does not apply thermoplastic adhesive to the fore edge of the book pad 15 but only to the back of the book as desired.

Although the dimensions of the apparatus according to the invention may be very small (for example, one apparatus made by applicant has a length of 900 mm., a width of 350 mm. and a height of 300 mm.), book pads of very great dimensions, e.g. 440 mm. in length, any width and 80 mm. in depth, can be adhesively bonded. Moreover, the capacity is very high despite the small dimensions and the simple design because a maximum of 12 to 16 seconds is necessary for adhesively bonding a book pad. Apart from the placing of the book pad into the clamping device, operation is virtually simple by means of push buttons. The machine is designed for continuous operation at temperatures up to 250°C. or even higher. Due to the small number of individual assemblies, it is not susceptible to trouble and failure and it is easy to repair because, for example, the whole adhesive applicator assembly 3 or the electronic control system can be replaced with a few manipulations. This is made possible especially by the use of standard parts corresponding, for example, to DIN or ASTM standards.

It is possible to supplement the machine according to the invention by a device to roughen the back of the book pad before binding. Furthermore, a conventional jarring table may be attached, thereby facilitating the insertion of the book pad 15 into the clamping device 2 and improving the bond strength of the melt adhesive on the back of the book.

It will be appreciated that the instant specification and examples are set forth by way of illustration and not limitation, and that various modifications and changes may be made without departing from the spirit and scope of the present invention.

What is claimed is:

1. An apparatus for gluing a stack of aligned sheets into a pad or book by applying a molten adhesive to the spine of the aligned sheets, comprising means for clamping said sheets with the aligned edges to be glued facing downwardly, a crucible for adhesive, means for melting said adhesive in said curcible, a glue applicator roll dipping into the molten adhesive in said curcible and extending above said adhesive, and means for moving said crucible with said applicator roll along the spine of the aligned sheets, said moving means comprising a pair of spaced parallel chains each resiliently connected to said crucible with said applicator roll, a plurality of cross-bars connecting said chains, the cross-bars downstream of said crucible, for a distance equal to at least about the length of the sheets to be glued, being substantially circular in cross-section so as to contact the aligned edges, the cross-bars upstream of said crucible for at least about an equal distance being substantially flat in cross-section, and a drive for moving said chains and the crucible and applicator roll therewith below and longitudinally of the stationary stack of sheets so as to apply adhesive thereto, whereby said applicator roll applies adhesive to the aligned edges of said sheets, the flat cross-section of said upstream portion of said bars preventing them from contacting said edges after adhesive has been applied thereto.

2. An apparatus according to claim 1, wherein said crucible with applicator roll is positioned between said chains and resiliently connected to both chains.

3. An apparatus according to claim 1, wherein the means for melting said adhesive is cast into said crucible and into said applicator roll.

4. An apparatus according to claim 1, including an upwardly directed blower immediately upstream of said applicator roll and moving together with said crucible and applicator roll, whereby a blast of cooling air to set said adhesive is applied immediately after said adhesive is applied.

5. An apparatus according to claim 1, wherein said clamping means includes at least one registering wicket provided with pins for projection through aligned apertures in the sheets of the stack, an apertured bar for positioning over the projecting ends of said pins and means for securing said wicket and bar in predetermined position for application of adhesive.

6. An apparatus according to claim 1, including means for raising and lowering the clamping means in predetermined position of said applicator roll, thereby ensuring that said roll does not initially strike and apply adhesive to an edge of each sheet of said stack perpendicular to the edge to which it is intended to apply adhesive.

7. An apparatus according to claim 1, wherein said applicator roll has a roughened surface to ensure uniform application of adhesive.

* * * * *

Disclaimer 3,956,057.—*Dietrich Jung*, St. Augustin, Germany. APPARATUS AND PROCESS FOR BINDING BOOKS WITH MOLTEN ADHESIVE. Patent dated May 11, 1976. Disclaimer filed Oct. 17, 1977, by the inventor.

Hereby enters this disclaimer to claims 1–7 of said patent.

[*Official Gazette March 14, 1978.*]